United States Patent [19]

Scholz et al.

[11] 4,138,321

[45] Feb. 6, 1979

[54] LIFTING DEVICE

[75] Inventors: Manfred Scholz, Erlangen; Bernd Gollasch, Nuremberg, both of Fed. Rep. of Germany

[73] Assignee: Kraftwerk Union Aktiengesellschaft, Mulheim, Fed. Rep. of Germany

[21] Appl. No.: 791,525

[22] Filed: Apr. 27, 1977

[30] Foreign Application Priority Data

Apr. 30, 1976 [DE] Fed. Rep. of Germany ..... 2619262
Mar. 2, 1977 [DE] Fed. Rep. of Germany ..... 2709071

[51] Int. Cl.[2] ..... C21C 19/10
[52] U.S. Cl. ..... 176/87; 176/30; 294/86 A
[58] Field of Search ..... 176/87, 30; 294/86 A, 294/86.13

[56] References Cited

U.S. PATENT DOCUMENTS

| | | | |
|---|---|---|---|
| 3,039,949 | 6/1962 | Newton et al. | 294/86 A X |
| 3,851,906 | 12/1974 | Frisch et al. | 176/87 X |
| 3,909,350 | 9/1975 | Dupay | 176/30 |
| 3,936,089 | 2/1976 | Hoffmeister | 176/30 X |
| 3,937,513 | 2/1976 | Hoffmeister | 176/30 X |
| 3,938,845 | 2/1976 | Fehl et al. | 294/86 A |

*Primary Examiner*—Peter A. Nelson
*Attorney, Agent, or Firm*—Herbert L. Lerner

[57] ABSTRACT

Lifting device for a horizontally seated cover of a nuclear-reactor pressure vessel includes a traverse having means for holding a cover to be lifted and having a substantially central point of application for a lifting tool, and means for compensating for deviations from the horizontal of the cover held by the traverse, the compensating means including a pair of mutually connected eccentrics cooperable for adjusting the point of application on the traverse in a horizontal plane.

8 Claims, 4 Drawing Figures

LIFTING DEVICE

The invention relates to a lifting device for a horizontally seated cover of nuclear-reactor pressure vessels and, more particularly, to such a device, having a traverse with a substantially central point of application or engagement for a lifting tool and with means for compensating for deviations from the horizontal of the cover connected to the traverse.

In German Patent DT-PS No. 1 960 368, there is disclosed a lifting device wherein compensation for deviations from the horizontal is effected through hydraulically actuatable intermediate members. The plane of the traverse therein, which is mounted on a crane hook by means of a central cardanic suspension system, is inclined with respect to the cover. This has proved to be successful in operation. Nevertheless, a need exists for a lifting device with which such a compensation is possible with simpler means and without auxiliary hydraulic energy.

It is accordingly an object of the invention to provide an improved lifting device which does indeed have means for effecting compensation for such deviations which are simpler than heretofore known and which requires no auxiliary hydraulic energy.

With the foregoing and other objects in view, there is provided, in accordance with the invention, a lifting device for a horizontally seated cover of a nuclear-reactor pressure vessel comprising a traverse having means for holding a cover to be lifted and having a substantially central point of application for a lifting tool, and means for compensating for deviations from the horizontal of the cover held by the traverse, the compensating means comprising a pair of mutually connected eccentrics cooperable for adjusting the point of application on the traverse in a horizontal plane. In this connection, adjustment of an inclination between the traverse and the cover need no longer be made, but rather the load application point is centered so that the traverse and the cover remain horizontal when lifted by the lifting tool.

In accordance with another feature of the invention, the eccentrics comprise an eccentrically rotatable circular pulley with a vertical axis seated eccentrically in another rotatable circular pulley having a vertical axis, the first-mentioned rotatable circular pulley eccentrically carrying the point of application for the lifting tool.

In accordance with a further feature of the invention, both of the rotatable circular pulleys are formed as gears, and also included are means for turnably adjusting the pulleys which are in meshing engagement with the pulleys.

In accordance with alternative additional features of the invention, the adjusting means comprise either a toothed rack, a gear or a worm. With the use of such features, the adjustment is especially accurate and is effected with minimal expenditure of energy.

In accordance with an added feature of the invention, rolling means, preferably a plurality of rollers, are disposed between the pulleys and the traverse for rollingly bracing the pulleys with respect to each other and with respect to the traverse.

In accordance with a concomitant feature of the invention, the point of application is formed by a carrying bolt seated on the first-mentioned or inner pulley, and a connecting head for the lifting tool is releasably connected to the carrying bolt. Due to the releasability of the connecting head, the possibility is presented of effecting an accommodation or adaptation to varying lifting tools so that the adjustability attained by the invention, which prevents deviations from the horizontal, can also be maintained with varying lifting tools.

Other features which are considered as characteristic for the invention are set forth in the appended claims.

Although the invention is illustrated and described herein as embodied in a lifting device, it is nevertheless not intended to be limited to the details shown, since various modifications and structural changes may be made therein without departing from the spirit of the invention and within the scope and range of equivalents of the claims.

The construction and method of operation of the invention, however together with additional objects and advantages thereof will be best understood from the following description of specific embodiments when read in connection with the accompanying drawings, in which.

Figure 2:
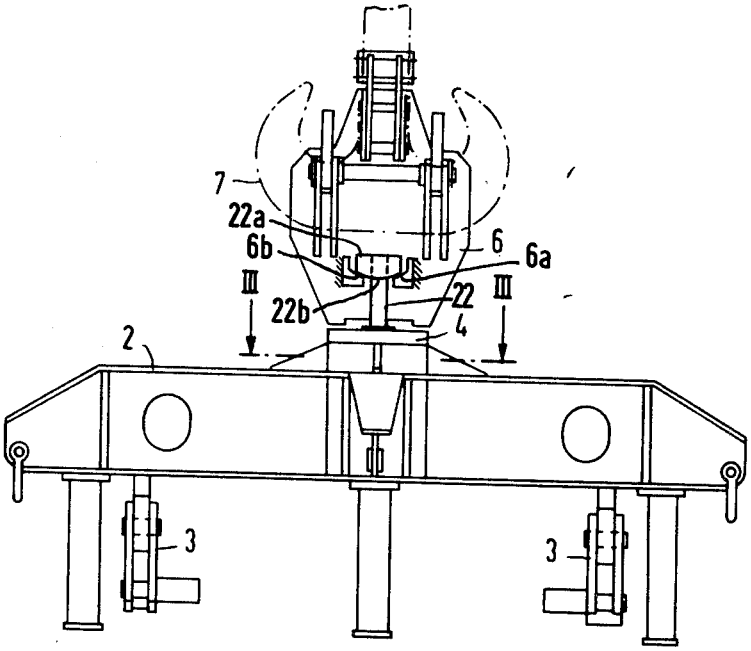
FIGS. 1 and 2 are top plan and side elevational views, respectiely, of the lifting device according to the invention in its entirety.
Figure 1:
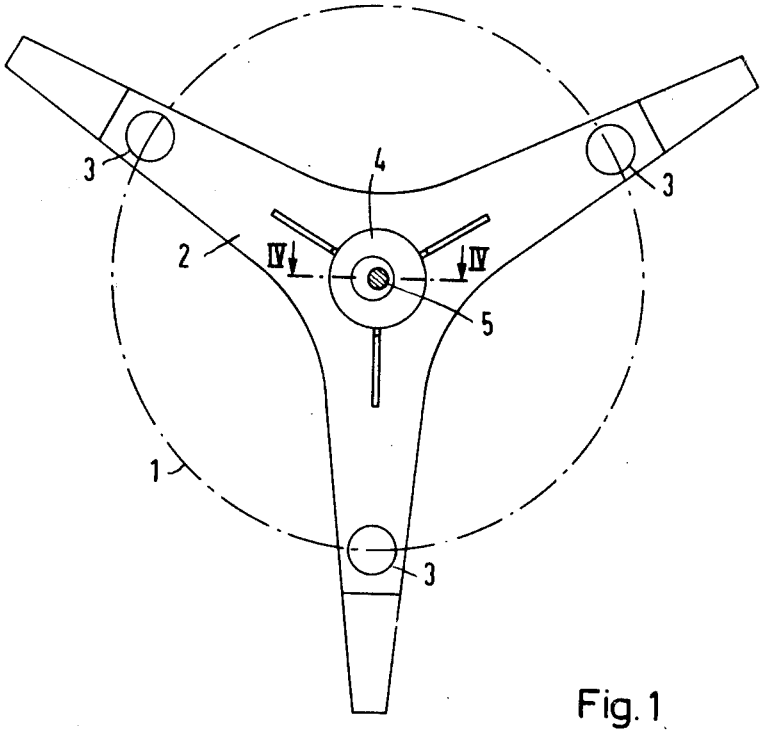

Referring now to the drawing and first, particularly, to FIGS. 1 and 2 thereof, there is represented in phantom a steel cover 1 of a reactor pressure vessel that is to be lifted by the lifting device according to the invention which includes as traverse a three-armed carrying star 2 having three holding members 3 which engage the cover 1. An adjusting device 4 is provided in the middle of the carrying star 2 and serves to vary the position relative to the traverse of a point of application 5 formed by a carrying bolt. The carrying bolt leads to a connecting head 6 for a lifting tool indicated by a crane hook 7 shown in phantom.

Figure 4:
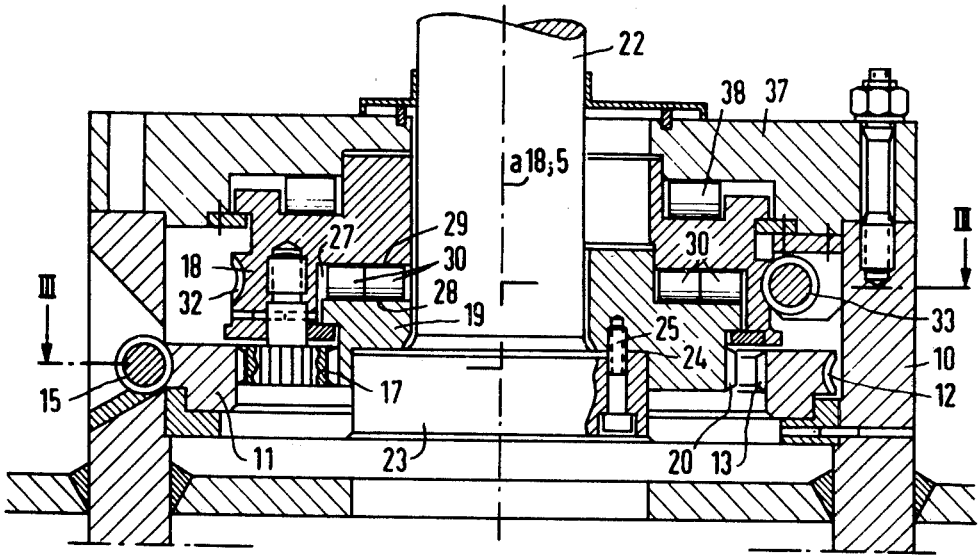
FIG. 4 is an enlarged fragmentary view of FIG. 1 taken generally along the line IV—IV therein and, more specifically, in a plane perpendicular to the plane of the drawing in FIG. 3.
Figure 3:
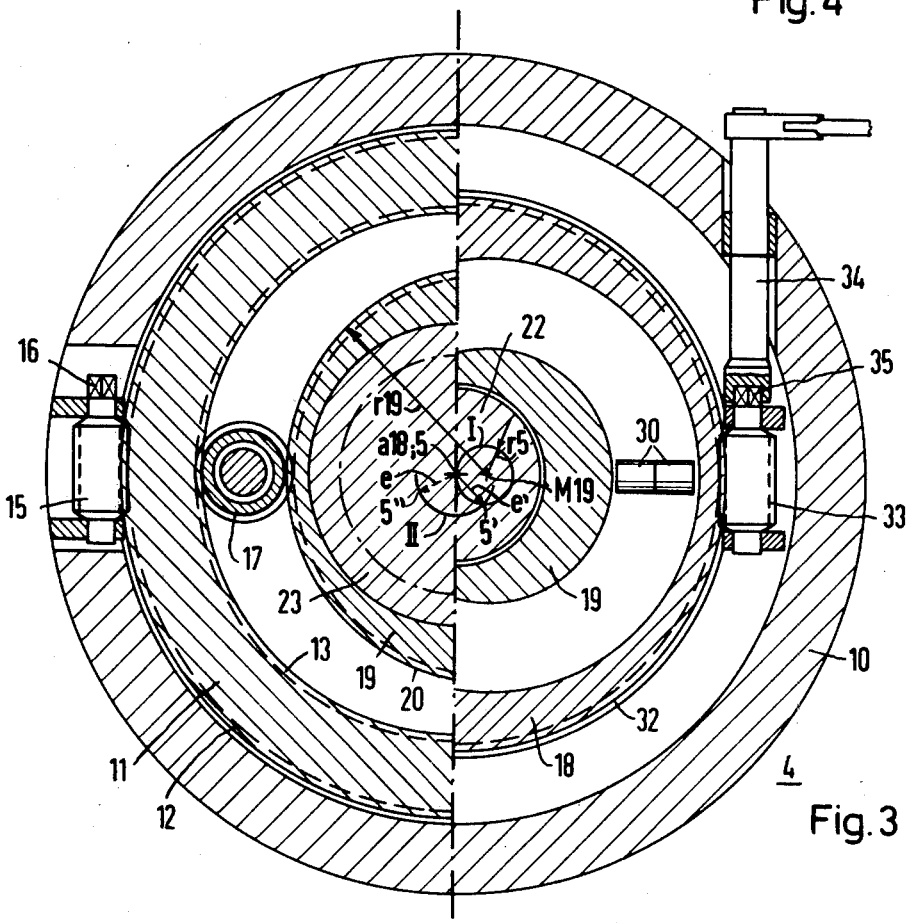
FIG. 3 is an enlarged fragmentary view of FIG. 2 taken generally along the line III—III therein and, more specifically, along the line III—III in FIG. IV.

It is apparent from FIG. 3 that the adjusting device 4 encompasses a largely cylindrical housing 10 wherein a ring 11 having outer toothing 12 and inner toothing 13 is seated. The outer toothing 12 cooperates with a worm 15 that is mounted in bearings in the housing 10 and is turnably actuable by means of a square head 16. The ring 11 which is turnably moved when the worm 15 is turned further turns a gear 17 which, as shown in FIG. 4, is mounted in a pulley 18 and is in meshing engagement with a toothing 20 provided at the outer peripheral edge of another pulley 19.

The pulley 18 is rotatably seated centrally in the housing 10. The pulley 19 is rotatably disposed eccentrically in the pulley 18. A carrying bolt 22 formed with a collar 23 is eccentrically fixed in the pulley 19, extending into a corresponding recess 24 formed in the pulley 19 and held therein by screws 25.

The pulley 19 extends into a recess 27 formed in the pulley 18. Between the horizontal surface 28 of the pulley 19 and the horizontal surface 29 of the pulley 18, both as viewed in FIG. 4, rollers 30 are disposed which, as roll bodies also when subjected to loading, permit a slight rotatability between the pulleys 18 and 19.

The pulley 18 is provided at the outer peripheral edge thereof with a toothing 32 meshing with a worm 33. The worm 33 can be turned by means of a key 34 that is seated on a square head 35 of the worm 33 in the housing 10.

Rollers 38 are seated between the pulley 18 and a housing cover 37 which is threadedly fastened to the housing 10, the rollers 38 ensuring relatively effortless rotatability.

The carrying bolt 22 can be adjusted with the aid of both eccentric pulleys 18 and 19 in a circle having a radius of, for example, 25 mm about the geometrical center of the traverse 2, so that the axis of the carrying bolt 22 passes through every desired point of the area of this circle. An accurate accommodation or watching of the point of application of the lifting tool i.e. the axis of the carrying bolt 22, to the common center of gravity of the traverse 2 and of the reactor cover 1 carried thereby is accordingly possible, so that the cover 1 can be lifted rectilinearly, without tilting, from a reactor pressure vessel and can also again be reseated in a similar manner thereon.

For yet a fuller understanding of the invention, attention is drawn to the following: In FIG. 2, it is diagrammatically indicated that the traverse 2 is cardanically i.e. universally, suspended on the connecting head by means of the carrying bolt 22. For this purpose, a carrying nut **22*a* is screwed onto the upper end of the carrying bolt 22, as viewed in FIG. 2, and has a spherically shaped underside 22*b* mounted on similarly spherically arched carrying surfaces 6*b* (ball sockets) of a carrying ring 6*a* rigidly connected to the connecting head 6**.

In FIGS. 3 and 4, the carrying bolt 22 is shown in centric position with respect to the adjusting device 4 i.e. the axis 5 thereof defining the force application point of the lifting tool coincides with the central axis a18 of the upper eccentric pulley 18. In the hereinafter following explanation, it is assumed that, caused by or contingent upon an oblique load, the center of gravity of the traverse, including the load thereof, is shifted slightly with an eccentricity e to a point 5'' i.e. beyond the axis 5 of the bolt 22. If the inner eccentric pulley 19 is then turned about the center M19 with the radius r19 thereof (this occurs by means of the worm 15 which thruns the ring 11 and by means of the gear 17 which is fixed in this case yet rotates about its own axis), the axis 5 of the carrying bolt 22 with the radius r5 of, for example, 25 mm, the axis 5 being disposed eccentrically to the point M19, moves around the point M19 on a circle I and assumes a position 5' with an eccentricity e' relative to the initial position 5 thereof. This eccentricity e' can be construed as a vector which corresponds in value to the vector of the desired eccentricity e. To tare the traverse with suspended load, the vector of this eccentricity e', which has an adjustment range between 0 and 2 × r5, must then be turned to the correct angular position i.e. brought into coincidence with the vector e. This occurs by turning the outer eccentric pulley 18 about the central axis a18 thereof (note FIG. 4) by means of the worm 33, the ring 11 being stationary and the outer eccentric pulley 18 entraining the inner eccentric pulley 19 in the same rotary direction by means of the gear 17 rolling around thereon. The axis 5 of the carrying bolt 22 is thereby moved from the position 5' thereof on the circle II into the position 5'' i.e. the center of gravity of the traverse 2 and the suspended load is brought into coincidence with the force application point 5 so that the traverse 2 is again completely horizontally adjusted on the cardanic suspension **22*a*, 6*a* thereof (FIG. 2). The slight relative rotation between both eccentric pulleys 18 and 19 occurring with the turning of the outer eccentric pulley 18 during the angular adjustment of the eccentricity e', can be readjusted or compensated by subsequent regulation or adjustment with the worm 15**.

There are claimed:

1. Lifting device for a horizontally seated cover of a nuclear-reactor pressure vessel comprising a traverse having means for holding a cover to be lifted and having a substantially central point of application for a lifting tool, and means for compensating for deviations from the horizontal of the cover held by said traverse, said compensating means comprising a pair of mutually connected eccentric pieces cooperable for adjusting said point of application on said traverse in a horizontal plane, said eccentric pieces comprising an eccentrically rotatable circular pulley with a vertical axis seated eccentrically in another rotatable circular pulley having a vertical axis, said first-mentioned pulley eccentrically carrying said point of application for the lifting tool, said point of application being formed by a carrying bolt seated on said first-mentioned pulley, and a connecting head for the lifting tool releasably connected to said carrying bolt.

2. Lifting device for a horizontally seated cover of a nuclear-reactor pressure vessel comprising a traverse having means for holding a cover to be lifted and having a substantially central point of application for a lifting tool, and means for compensating for deviations from the horizontal of the cover held by said traverse, said compensating means comprising a pair of mutually connected eccentric pieces cooperable for adjusting said point of application on said traverse in a horizontal plane, said eccentric pieces comprising an eccentrically rotatable circular pulley with a vertical axis seated eccentrically in another rotatable circular pulley having a vertical axis, said first-mentioned rotatable circular pulley eccentrically carrying said point of application for the lifting tool.

3. Lifting device according to claim 2 wherein both of said rotatable circular pulleys are formed as gears, and including means for turnably adjusting said pulleys being in meshing engagement therewith.

4. Lifting device according to claim 3 wherein said adjusting means comprise a toothed rack.

5. Lifting device according to claim 3 wherein said adjusting means comprise a gear.

6. Lifting device according to claim 3 wherein said adjusting means comprise a worm.

7. Lifting device for a horizontally seated cover of a nuclear-reactor pressure vessel comprising a traverse having means for holding a cover to be lifted and having a substantially central point of application for a lifting tool, and means for compensating for deviations from the horizontal of the cover held by said traverse, said compensating means comprising a pair of mutually connected eccentric pieces cooperable for adjusting said point of application on said traverse in a horizontal plane, said eccentric pieces comprising an eccentrically rotatable circular pulley with a vertical axis seated eccentrically in another rotatable circular pulley having a vertical axis, said first-mentioned pulley eccentrically carrying said point of application for the lifting tool, and rolling means disposed between said pulleys and said traverse for rollingly bracing said pulleys with respect to each other and with respect to said traverse.

8. Lifting device according to claim 7 wherein said rolling means comprise a plurality of rollers.

* * * * *